US010774464B2

(12) United States Patent
Bensel et al.

(10) Patent No.: US 10,774,464 B2
(45) Date of Patent: Sep. 15, 2020

(54) LAUNDRY APPLIANCE HAVING AN IRONING ASSEMBLY

(71) Applicant: Haier US Appliance Solutions, Inc., Wilmington, DE (US)

(72) Inventors: Peter Hans Bensel, Louisville, KY (US); Rafael Baldo Sanz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 4 days.

(21) Appl. No.: 16/128,590

(22) Filed: Sep. 12, 2018

(65) Prior Publication Data

US 2020/0080256 A1 Mar. 12, 2020

(51) Int. Cl.

| | |
|---|---|
| ***D06F 79/02*** | (2006.01) |
| ***D06F 29/00*** | (2006.01) |
| ***D06F 58/20*** | (2006.01) |
| ***D06F 75/08*** | (2006.01) |
| ***D06F 83/00*** | (2006.01) |

(52) U.S. Cl.

CPC ..... *D06F 79/02* (2013.01); *D06F 29/00* (2013.01); *D06F 58/20* (2013.01); *D06F 75/08* (2013.01); *D06F 83/00* (2013.01)

(58) Field of Classification Search

CPC ..... D06F 79/02; D06F 79/023; D06F 79/026; D06F 29/00; D06F 29/005; D06F 58/20; D06F 75/08; D06F 75/40; D06F 67/00; D06F 67/005; D06F 83/00; D06F 81/00; D06F 81/003; D06F 81/02; D06F 81/06; D06F 85/00

See application file for complete search history.

(56) References Cited

U.S. PATENT DOCUMENTS

| | | | | |
|---|---|---|---|---|
| 1,339,831 | A * | 5/1920 | Locke | D06F 81/00 38/137 |
| 1,570,955 | A * | 1/1926 | Evans | D06F 81/02 108/33 |
| 3,719,220 | A * | 3/1973 | Small | A47H 2/00 160/108 |
| 4,636,613 | A | 1/1987 | McRandere | |
| 7,299,573 | B1 * | 11/2007 | Kuncken | D06F 83/00 38/140 |
| 7,587,917 | B2 | 9/2009 | Gilbee et al. | |
| 8,322,169 | B2 * | 12/2012 | Kendall | D06F 29/00 68/13 R |
| 8,464,446 | B1 * | 6/2013 | Dinon | D06F 83/00 38/140 |

(Continued)

FOREIGN PATENT DOCUMENTS

| | | | |
|---|---|---|---|
| DE | 102006021279 | A1 * | 11/2007 |
| EP | 1925703 | B1 | 1/2010 |

(Continued)

*Primary Examiner* — Ismael Izaguirre

(74) *Attorney, Agent, or Firm* — Dority & Manning, P.A.

(57) ABSTRACT

A laundry appliance and ironing assembly are provided herein. The laundry appliance may include a cabinet and an ironing assembly. The cabinet may extend along a vertical direction between a top portion and a bottom portion. The cabinet may define a laundry chamber for the receipt of articles therein. The ironing assembly may include a casing received on a laundry appliance and an insulated mat selectively received within the casing.

19 Claims, 6 Drawing Sheets

(56) References Cited

U.S. PATENT DOCUMENTS

| | | | | |
|---|---|---|---|---|
| 9,845,561 | B2 | 12/2017 | Doyle et al. | |
| 2003/0002235 | A1* | 1/2003 | Takeda | H02H 5/043 361/107 |
| 2005/0050732 | A1* | 3/2005 | Peter | B26B 19/40 30/41 |
| 2009/0206059 | A1* | 8/2009 | Kiko | H02J 3/14 218/143 |

FOREIGN PATENT DOCUMENTS

| | | | | |
|---|---|---|---|---|
| GB | 2297982 | B | | 3/1999 |
| JP | 06071100 | A | * | 3/1994 |
| JP | H06343794 | A | | 12/1994 |
| KR | 2009115103 | A | | 11/2009 |

* cited by examiner

LAUNDRY APPLIANCE HAVING AN IRONING ASSEMBLY

FIELD OF THE INVENTION

The present subject matter relates generally to laundry appliances, and more particularly to washer or dryer appliances having one or more features for pressing or steaming articles thereon.

BACKGROUND OF THE INVENTION

Irons or ironing assemblies are commonly used to heat or press clothing articles. For instance, heat and steam may be conducted through a bottom plate of an ironing assembly in order to remove wrinkles from an article of clothing in contact with the bottom plate. In order to support the article of clothing and ironing assembly, as well as to prevent heat from damaging the surrounding area, a dedicated ironing board must generally be used. Oftentimes, it can be most effective to press an article of clothing soon after it has been treated by a laundry appliance. For instance, it may be easiest to remove or prevent wrinkles by pressing an article of clothing immediately after it has been washed or dried by a washing machine appliance or dryer appliance, respectively. Convenience or space concerns often lead users to store or use an iron in close proximity to his or her laundry appliances. In particular, it may be common to store or use an ironing assembly in a designated laundry room of a house or apartment.

In some instances, storing or using an ironing assembly within a designated laundry room or area may be especially difficult. For instance, a particular user's laundry room may be too small to accommodate a standard ironing board. Additionally or alternatively, the user may lack a suitable place to store the ironing assembly when it is not in use. Simply placing the ironing assembly on top of a nearby washing machine appliance or dryer appliance may cause a number of difficulties. For instance, movement of either the washing machine appliance or dryer appliance during use may cause the ironing assembly to fall off. Moreover, heat from the ironing assembly (e.g., immediately after use) may risk damaging the appearance or internal components of the washing machine appliance or dryer appliance.

As a result, there is a need for an improved laundry appliance or ironing assembly. In particular, it would be advantageous to provide a laundry appliance or ironing assembly addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ironing assembly is provided. The ironing assembly may include a casing received on a laundry appliance, an insulated mat, and a ground fault circuit interrupter (GFCI) switch. The insulated mat may be selectively received within the casing. The GFCI switch may be mounted within the casing.

In another exemplary aspect of the present disclosure, a laundry appliance is provided. The laundry appliance may include a cabinet and an ironing assembly. The cabinet may extend along a vertical direction between a top portion and a bottom portion. The cabinet may define a laundry chamber for the receipt of articles therein. The ironing assembly may include a casing received on a laundry appliance, an insulated mat, and a ground fault circuit interrupter (GFCI) switch. The insulated mat may be selectively received within the casing. The GFCI switch may be mounted within the casing.

In yet another exemplary aspect of the present disclosure, an ironing assembly is provided. The ironing assembly may include a casing received on a laundry appliance, a winding spool, and an insulated mat. The casing may include a platform positioned at a top end of the casing to receive an ironing press on the platform. The casing may define an internal cavity below the platform. The winding spool may be mounted within the internal cavity. The insulated mat may be selectively wound about the winding spool. The insulated mat may be movable between a storage position and a use position. The storage position may include the insulated mat received within the internal cavity about the winding spool. The use position may include at least a portion of insulated mat removed from internal cavity to receive and contact the ironing press.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
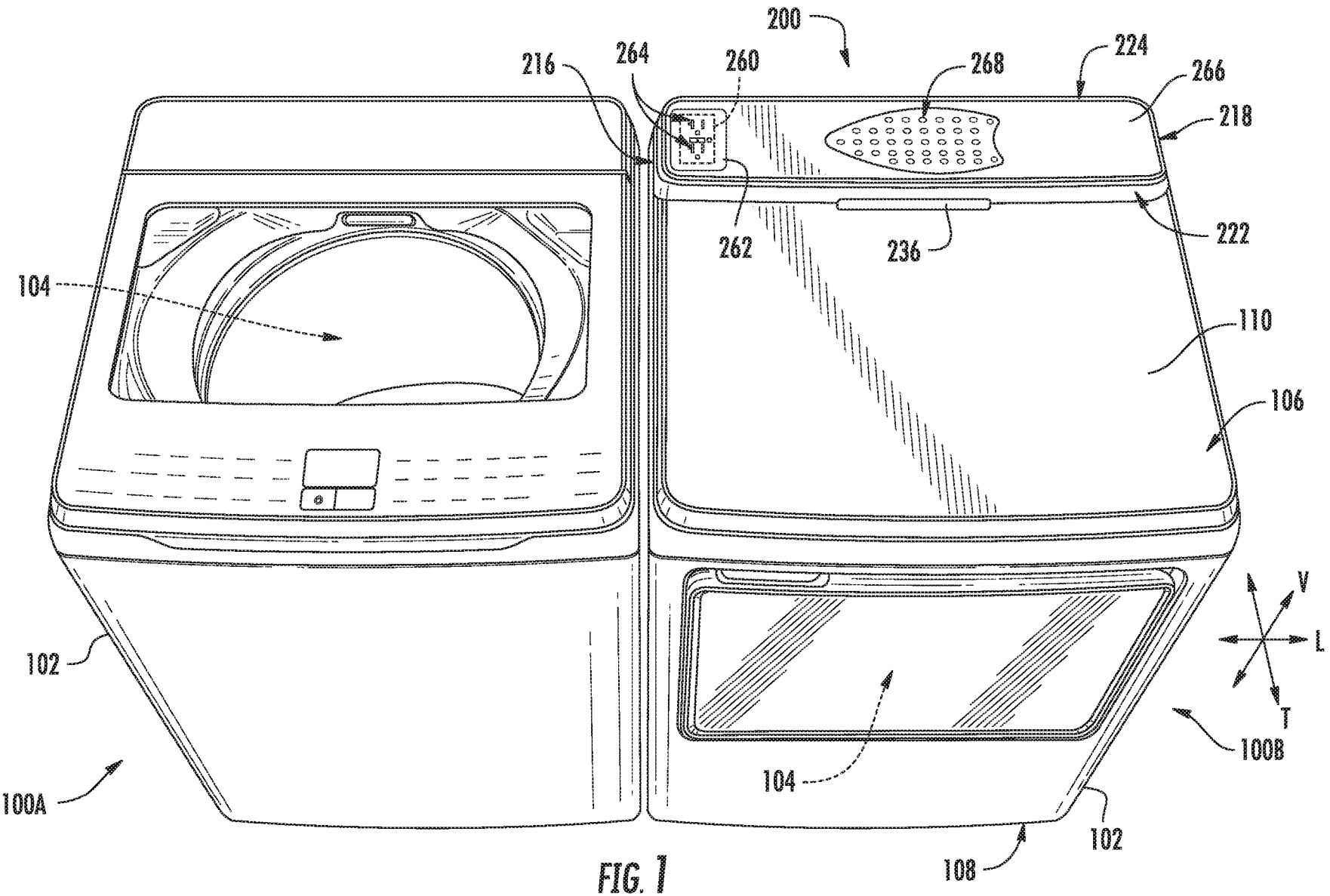
FIG. 1 provides a perspective view of a washing machine appliance and dryer appliance according to exemplary embodiments of the present disclosure, wherein an ironing assembly is in a storage position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present disclosure. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
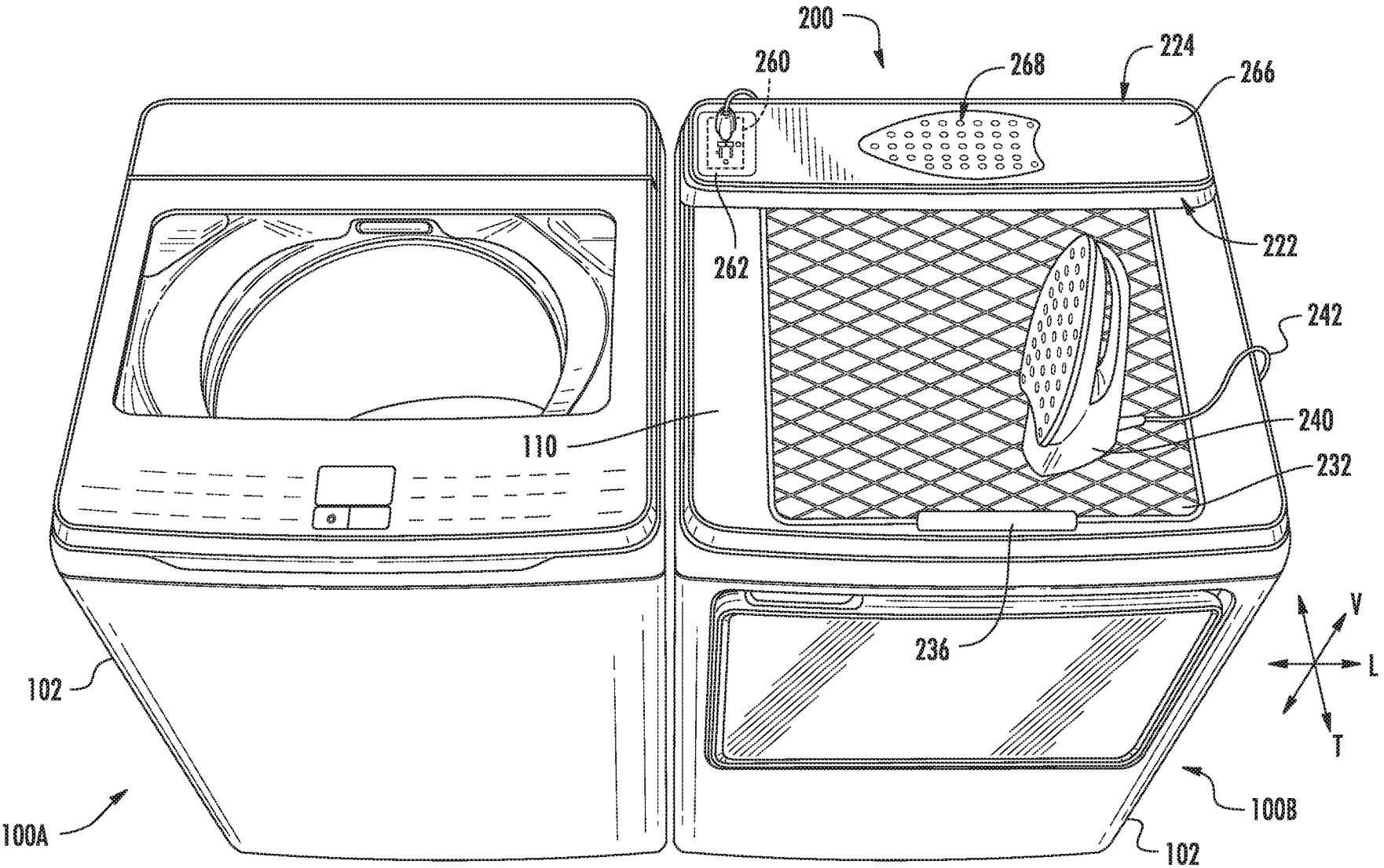
FIG. 2 provides a perspective view of the exemplary washing machine appliance and dryer appliance of FIG. 1, wherein the ironing assembly is in a use position.
Figure 4:
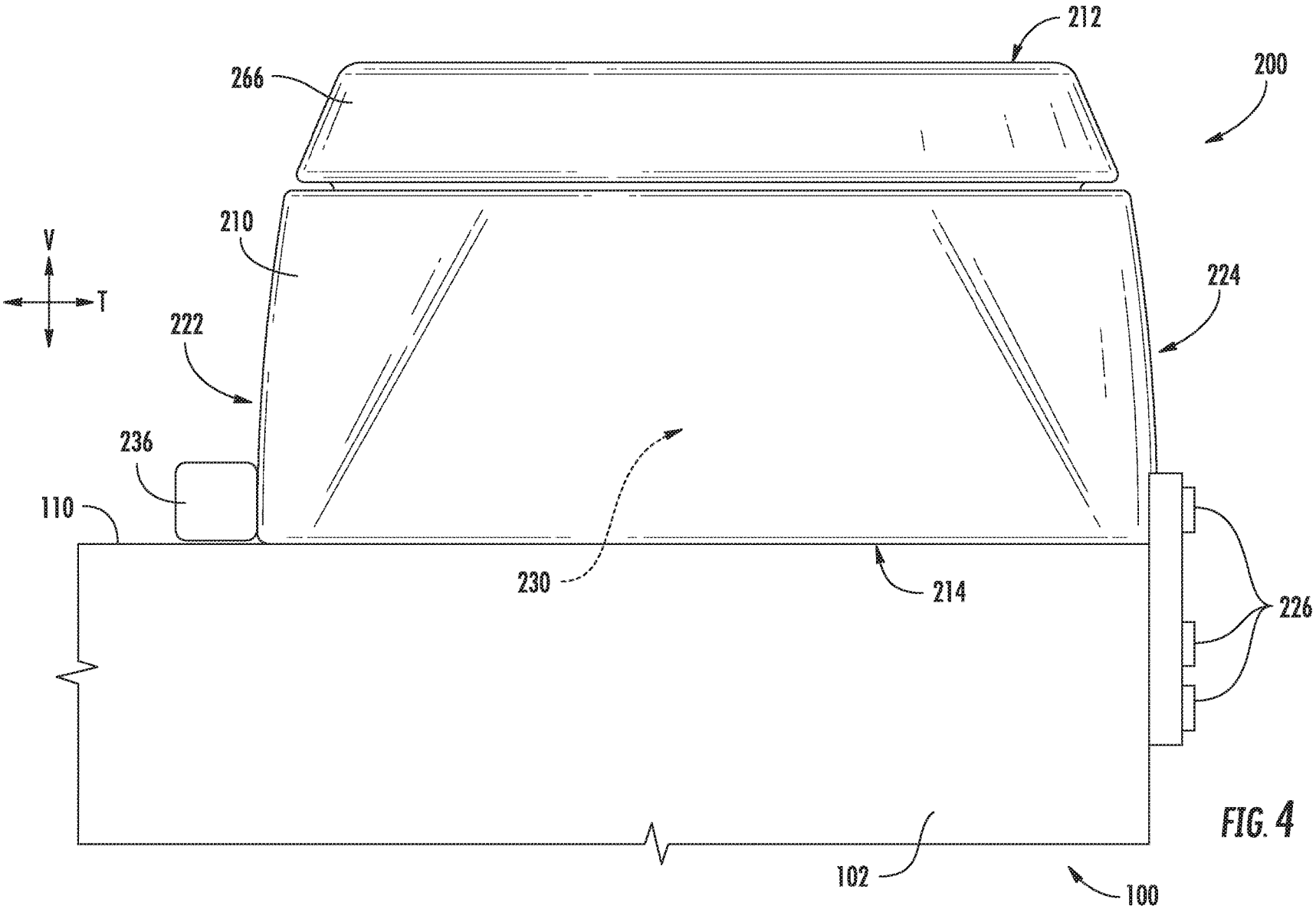
FIG. 4 provides a side view of an ironing assembly mounted to a laundry appliance according to exemplary embodiments of the present disclosure.
Figure 5:
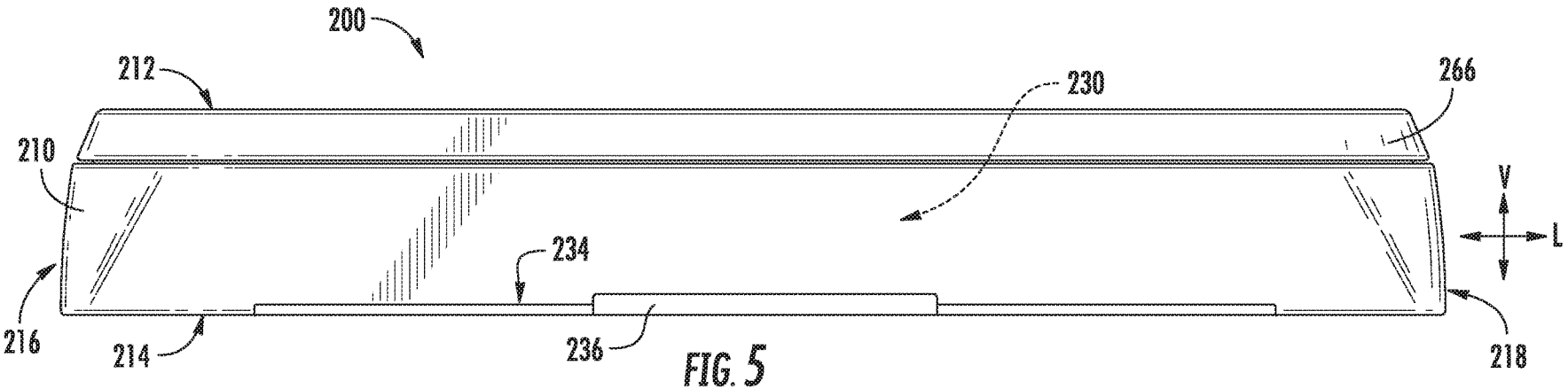
FIG. 5 provides a front perspective view of an ironing assembly according to exemplary embodiments of the present disclosure.
Figure 6:
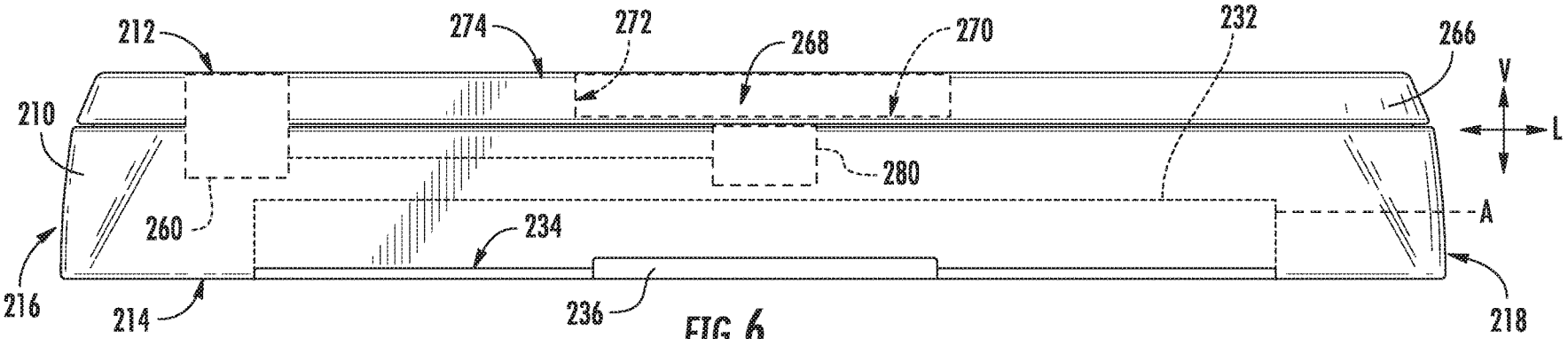
FIG. 6 provides a front schematic view of an ironing assembly according to exemplary embodiments of the present disclosure.

Turning now to the figures, FIGS. 1 and 2 provide various perspective views of a pair of laundry appliances (e.g., washing machine appliance 100A and dryer appliance 100B) that generally define an orthogonal directional system, including a vertical direction V, lateral direction L, and transverse direction T. As shown, each laundry appliance 100 (FIG. 4) includes a cabinet 102 that defines a laundry chamber 104 for receiving clothes or articles therein. In particular, the washing machine appliance 100A defines a wash chamber within which clothing articles may be washed, agitated, spun, etc. The dryer appliance 100B defines a drying chamber within which clothing articles may be heated, tumbled, dried, etc. (e.g., after being washed within the washing machine appliance 100A).

Although a discrete washing machine appliance 100A and dryer appliance 100B are shown, is understood that these are merely nonlimiting exemplary embodiments. The present disclosure may include or may be equally applied to any suitable laundry appliance. For instance, another laundry appliance or configuration may be provided, such as a frontloading washing machine appliance.

Generally, an ironing assembly 200 including a casing 210 may be provided on (e.g., supported on top of or mounted onto) a corresponding laundry appliance (e.g., dryer appliance 100B). As shown, the corresponding laundry appliance may extend along the vertical direction V from a top portion 106 to a bottom portion 108. Along the top portion 106, a rigid upper panel 110 may be provided (e.g., perpendicular to the vertical direction V). In some such embodiments, the casing 210 of the ironing assembly 200 is positioned above the upper panel 110. For instance, the ironing assembly 200 may rest on the upper panel 110.

Turning now to FIGS. 1, 2, and 4 through 6, FIGS. 4 through 6 provide various views of ironing assembly 200 according to exemplary embodiments of the present disclosure. As illustrated in FIGS. 1, 2, and 4 through 6, casing 210 generally extends along the vertical direction V between a top end 212 and a bottom end 214; along the lateral direction L between a first end 216 and a second end 218; and along the transverse direction T between a front end 222 and a rear end 224. In optional embodiments, one or more adhesives, magnets, or mechanical fasteners 226 (e.g., bolts, screws, hooks, brackets, etc.) may selectively join casing 210 to cabinet 102 (e.g., at a rear portion thereof).

Within casing 210, an internal cavity 230 is defined (e.g., to selectively receive one or more components of ironing assembly 200). In particular, the internal cavity 230 may selectively receive an insulated mat 232. Insulated mat 232 is generally formed from a suitable nonrigid heat resistant material or fabric. For instance, the insulated mat 232 may include treated or untreated cotton, high temperature silicone, fabric batting, or any other suitable material for contacting an active ironing press 240 (e.g., directly or indirectly through a clothing article while the clothing articles being steamed or pressed).

When assembled, the insulated mat 232 may be selectively moved (e.g., through an opening 234 defined by casing 210) between a storage position (FIG. 1) and a use position (FIG. 2). In the storage position, insulated mat 232 (e.g., most or all of insulated mat 232) may be received within internal cavity 230. Generally, insulated mat 232 will be hidden from view and enclosed within casing 210. By contrast, in the use position, insulated mat 232 (e.g., most or all of insulated mat 232) may be removed from internal cavity 230. For instance, the insulated mat 232 may be pulled through an opening 234 (e.g., having a lateral width greater than the lateral width of the insulated mat 232) as the insulated mat 232 moves from the storage position to the use position. In the use position, insulated mat 232 may thus contact or receive ironing press 240 thereon.

In some embodiments, a handle 236 is attached or fixed to insulated mat 232 (e.g., permitting a user to move the insulated mat 232 between the storage position and use position). Thus, the handle 236 may generally move with the rest of insulated mat 232. In some such embodiments, the handle 236 may remain outside of the internal cavity 230, or otherwise accessible to user, while insulated mat 232 is in storage position. For instance, the handle 236 may be proximal to the front end 222 of casing 210 or opening 234 in the storage position. In the use position, the handle 236 may be distal to the front end 222 of casing 210 or opening 234. In other words, the handle 236 may be spaced apart from casing 210 (e.g., along the transverse direction T). Additionally or alternatively, the handle 236 may be closer to a front portion of the laundry appliance on which casing 210 is supported (e.g., dryer appliance 100B) when insulated mat 232 is in the use position compared to the storage position.

Figure 7:
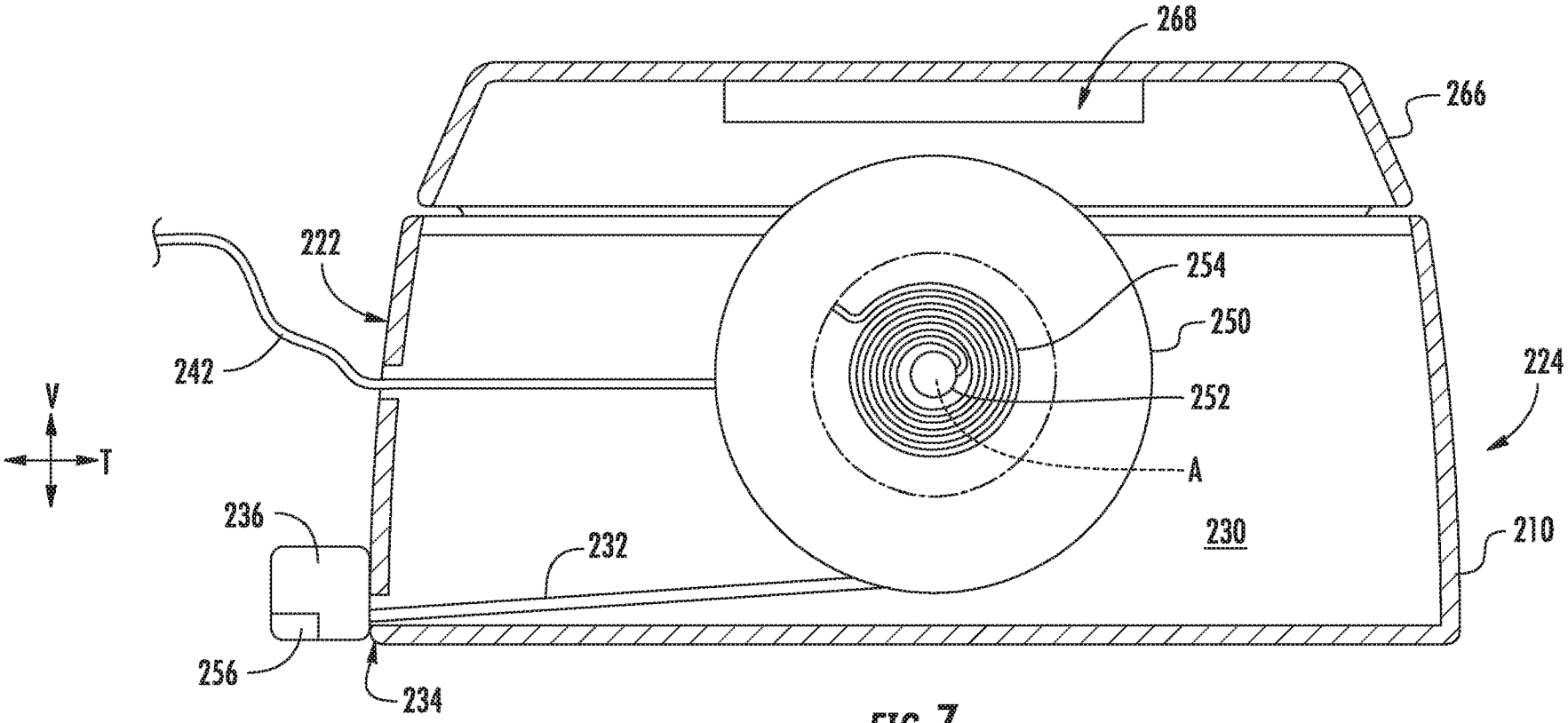
FIG. 7 provides a side cross-sectional view of an ironing assembly according to exemplary embodiments of the present disclosure.

Turning briefly to FIG. 7, a schematic cross-sectional side view is provided of ironing assembly 200 according to exemplary embodiments of the present disclosure. As shown, insulated mat 232 may be fixed or attached to a winding spool 250 mounted within casing 210 or internal cavity 230. For instance, insulated mat 232 may have one end that is attached or fixed to a support rod 252 of winding spool 250 (e.g., opposite of handle 236). Support rod 252 may generally extend along the lateral direction L across a width that is, for example, larger than the width of insulated mat 232. Moreover, support rod 252 may be rotatable about a spool axis A (e.g., parallel to lateral direction L). Thus, insulated mat 232 may be selectively wound about the winding spool 250. In particular, when insulated mat 232 is in the storage position, at least a portion of insulated mat 232 may be wrapped around or about the spool axis A and support rod 252 within internal cavity 230.

In certain embodiments, winding spool 250 includes a retraction spring 254 (e.g., coaxial with the spool axis A) that generally motivates or biases winding spool 250 to the storage position. For instance, the retraction spring 254 may extend from or about support rod 252. The retraction spring 254 may be provided as a torsion spring, or any suitable elastic spring configured to motivate or bias the winding spool 250 to a wound position (e.g., the storage position). In optional embodiments, a mechanical retainer 256 (e.g., a magnet, adhesive, or hook) is fixed to handle 236, or another suitable portion of insulated mat 232, to hold insulated mat 232 in the use position (e.g., against upper panel 110 in opposition to the retracting or winding force provided by retraction spring 254). In additional or alternative embodiments, a ratcheting or gear assembly (not pictured) is provided on winding spool 250 to selectively hold insulated mat 232 in the use position (e.g., in opposition to the retracting or winding force provided by retraction spring 254). In further additional or alternative embodiments, a rotation lever (not pictured) is provided on winding spool 250 outside of internal cavity 230 to permit manual winding or rotation of winding spool 250 about spool axis A by a user.

Returning to FIGS. 1, 2, and 4 through 6, a ground fault circuit interrupter (GFCI) switch 260 is mounted within the casing 210. For instance, GFCI switch 260 may be positioned, at least in part, within internal cavity 230. As is understood, a plug or wire connected to a municipal power supply (e.g., through an electrical wall socket) may connect to GFCI switch 260, such that GFCI switch 260 is in electrical communication (e.g., through one or more conductive wires or buses) with the municipal power source (e.g., during use). As is further understood, GFCI switch 260 may include one or buttons (e.g., testing button or reset button) for testing or adjusting the status of the GFCI switch 260, as well as one or more indicator lights for communicating the status of the GFCI switch 260 to a user. Ironing press 240 may be in electrical communication with GFCI switch 260 (e.g., through a conductive power cord 242 of ironing press 240). From GFCI switch 260, ironing press 240 may thus connect to the municipal power source. In other words, ironing press 240 may be in electrical communication with the municipal power source through GFCI switch 260.

As shown, in certain embodiments, a power receptacle 262 having one or more electrical outlet plugs 264 (e.g., standard 3-prong outlets) may be mounted to casing 210. An electrical device, such as ironing press 240, having a mating inlet plug may selectively connect and disconnect from power receptacle 262. In some such embodiments, GFCI switch 260 is provided within power receptacle 262 such that GFCI switch 260 is electrically connected between the municipal power source and outlet plugs 264. Thus, an electrical device (e.g., ironing press 240) that is electrically connected to power receptacle 262 may also be electrically connected to GFCI switch 260.

Figure 3:
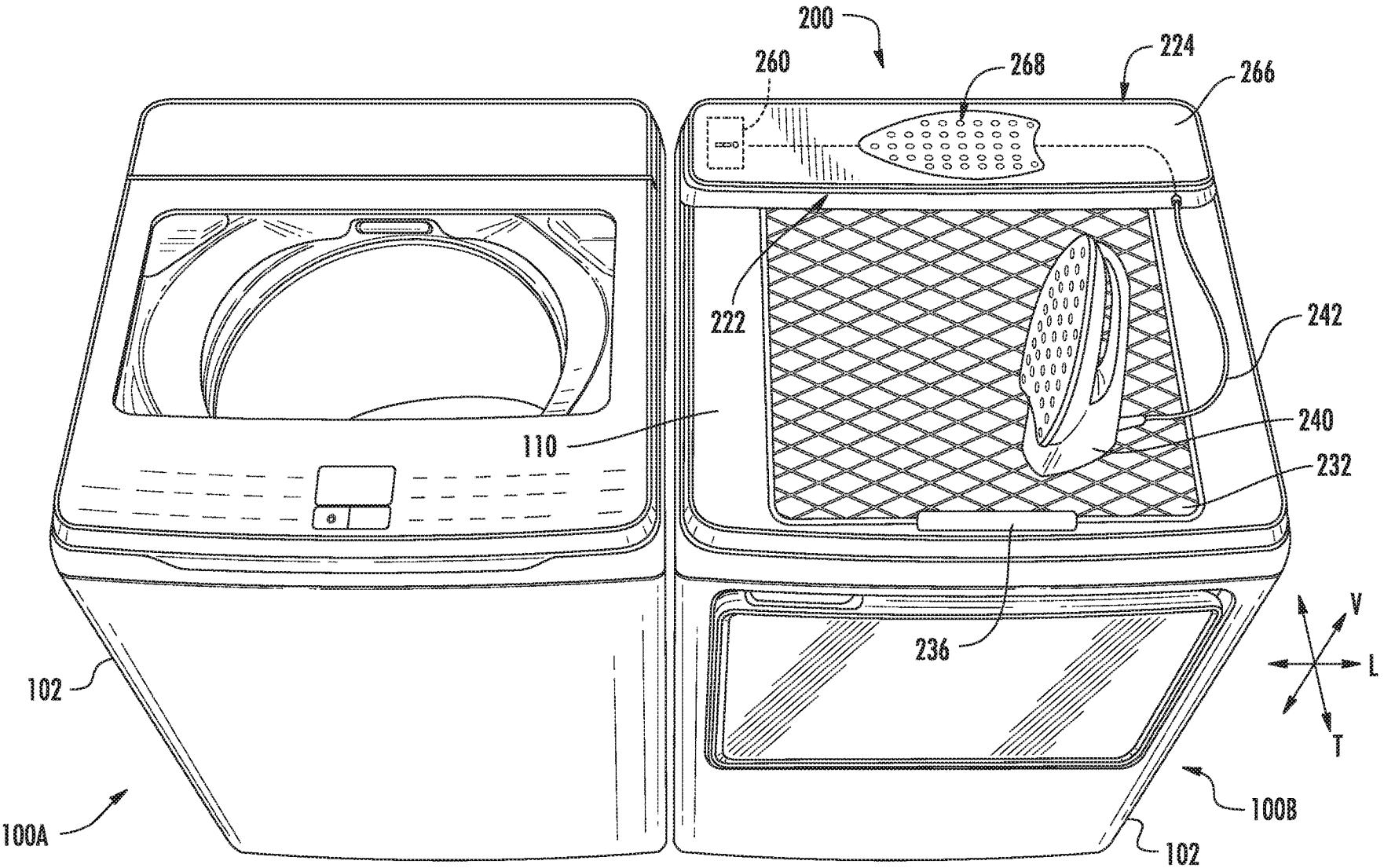
FIG. 3 provides a perspective view of a washing machine appliance and dryer appliance according to other exemplary embodiments of the present disclosure.

Although FIGS. 1 and 2 illustrate ironing press 240 electrically connected to GFCI switch 260 through the outlet plugs 264 of power receptacle 262, it is understood that a more permanent connection may be established. For instance, turning briefly to FIG. 3, ironing press 240 may be hardwired to casing 210 and the GFCI switch 260 therein. Thus, in exemplary embodiments, electrical communication between GFCI switch 260 and ironing press 240 is fixed.

Returning now to FIG. 7, in some embodiments, the power cord 242 from ironing press 240 (FIG. 1) to casing 210 is provided as a retractable cord. As an example, power cord 242 may be fixed or attached to a winding spool 250 mounted within casing 210 or internal cavity 230 (e.g., in tandem with or, alternatively, separate from insulated mat 232). In some such embodiments, power cord 242 has one end that is attached or fixed to a support rod 252 of winding spool 250 (e.g., opposite of ironing press 240). Support rod 252 may generally extend along the lateral direction L across a width that is, for example, larger than the width of power cord 242. Moreover, support rod 252 may be rotatable about a spool axis A (e.g., parallel to lateral direction L). Thus, power cord 242 may be selectively wound about the winding spool 250. For instance, the power cord 242 may be provided in a storage position similar to or different from the insulated mat 232. When power cord 242 is in the storage position, at least a portion of power cord 242 may be wrapped around or about the spool axis A and support rod 252 within internal cavity 230.

Returning now generally to FIGS. 1 through 7, in certain embodiments, the casing 210 includes a platform 266 positioned above the internal cavity 230. For instance, the platform 266 may extend along the lateral direction L and transverse direction T (e.g., perpendicular to the vertical direction V) at the top end 212 of casing 210. Optional embodiments of the platform 266 extend from first end 216 to second end 218. Additional or alternative embodiments of the platform 266 extend from front end 222 to rear end 224.

Platform 266 is generally formed from a suitable rigid heat resistant material (e.g., metal, rigid high temperature polymers, etc.). When assembled, platform 266 may selectively receive or support an ironing press 240 thereon. As understood by one of ordinary skill, ironing press 240 generally includes one or more heating elements or steam systems to conduct heat or steam through a heating plate of the ironing press 240 (e.g., when the ironing press 240 is in contact with an article of clothing). Thus, platform 266 may be configured to support or contact the lower plate of the ironing press 240 without incurring noticeable or meaningful damage.

In certain embodiments, platform 266 defines a recess 268 complementary to the ironing press 240. For instance, the recess 268 defined by the platform 266 may be generally shaped to match or bound a portion of ironing press 240 (e.g., the heating plate of the ironing press 240). In some such embodiments, the recess 268 includes a bottom surface 270 and perimeter wall 272 (e.g., extending about the perimeter of bottom surface 270) positioned below a top surface 274 of the platform 266, but open along the vertical direction V to receive the ironing press 240. In additional or alternative embodiments, recess 268 is defined by a vertically-extended perimeter wall positioned above top surface 274. In alternative embodiments, platform 266 defines a flush top surface 272 (i.e., substantially free of any discrete recess).

In some embodiments, a detection switch 280 is provided in operative communication with recess 268 or platform 266 to detect ironing press 240. As an example, detection switch 280 may be positioned within casing 210 below platform 266. As a further example, detection switch 280 may be mounted directly beneath recess 268. Detection switch 280 may be provided as any suitable sensor or switch that is configured to detect ironing press 240 within recess 268. For instance, detection switch 280 may be provided as or include a proximity sensor (e.g., reed switch or hall effect sensor, which detects the presence of a magnet embedded in ironing press 240).

In certain embodiments, detection switch 280 is provided as a pressure switch. The weight or change in pressure caused by placing ironing press 240 on or within recess 268 may thus be detected at the detection switch 280. In some such embodiments, platform 266 is a vertically-slidable assembly (e.g., vertically biased spring-loaded plate) that is configured to descend and engage detection switch 280 in response to receiving the weight or force of ironing press 240. In other embodiments, platform 266 is a rigid (e.g., non-sliding) assembly whereat detection switch 280 is configured to detect the weight or force of ironing press 240.

Generally, detection switch 280 may be provided as any suitable pressure-detecting device. In certain embodiments, detection switch 280 disposed in electrical communication with GFCI switch 260. During use, detection of ironing press 240 at detection switch 280 may restrict or halt an electrical current through GFCI switch 260. As an example, detection switch 280 may be a mechanically actuated microswitch. The microswitch may be configured to electrically connected to trip or actuate GFCI switch 260 to ground when the ironing press 240 is positioned on top of platform 266 and detection switch 280. As another example, detection switch 280 may be a mechanical, normally closed gate switch in series connection with GFCI switch 260 (e.g., in electrical series between ironing press 240 and GFCI switch 260). Positioning ironing press 240 on top of platform 266 and detection switch 280 may thus cause the detection switch 280 to open, breaking the electrical connection between, for example, ironing press 240 and municipal power source to which GFCI switch 260 is connected.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ironing assembly positionable on a laundry appliance, the ironing assembly comprising:

a casing received on the laundry appliance, the casing the casing comprising a platform defining a recess;

an insulated mat selectively received within the casing;

a ground fault circuit interrupter (GFCI) switch mounted within the casing;

an ironing press in electrical communication with the GFCI switch; and a detection switch in operative communication with the recess to detect the ironing press thereon, wherein the recess is complementary to the ironing press, and wherein the ironing press is selectively received within the recess.

2. The ironing assembly of claim 1, further comprising a winding spool mounted within the casing, wherein the ironing press comprises a retractable cord, and wherein the retractable cord is selectively wound about the winding spool.

3. The ironing assembly of claim 1, wherein the detection switch is disposed in electrical communication with the GFCI switch.

4. The ironing assembly of claim 1, further comprising a power receptacle mounted to the casing.

5. The ironing assembly of claim 4, wherein the GFCI switch is provided within the power receptacle.

6. The ironing assembly of claim 1, further comprising a winding spool mounted within the casing, and wherein the insulated mat is selectively wound about the winding spool.

7. The ironing assembly of claim 6, wherein the winding spool comprises support rod and a retraction spring extending from the support rod.

8. An ironing assembly positionable on a laundry appliance, the ironing assembly comprising:

a casing received on the laundry appliance;

an insulated mat selectively received within the casing;

a ground fault circuit interrupter (GFCI) switch mounted within the casing; and an ironing press in electrical communication with the GFCI switch, a winding spool mounted within the casing, wherein the ironing press comprises a retractable cord, and wherein the retractable cord is selectively wound about the winding spool.

9. The ironing assembly of claim 8, further comprising a detection switch in operative communication with the recess to detect the ironing press thereon, wherein the detection switch is disposed in electrical communication with the GFCI switch.

10. The ironing assembly of claim 8, further comprising a power receptacle mounted to the casing.

11. The ironing assembly of claim 10, wherein the GFCI switch is provided within the power receptacle.

12. The ironing assembly of claim 8, wherein the insulated mat is selectively wound about the winding spool.

13. The ironing assembly of claim 8, wherein the winding spool comprises support rod and a retraction spring extending from the support rod.

14. The ironing assembly of claim 8, wherein the casing comprises a platform defining a recess complementary to the ironing press, and wherein the ironing press is selectively received within the recess.

15. An ironing assembly positionable on a laundry appliance, the ironing assembly comprising:

a casing received on the laundry appliance;

an insulated mat selectively received within the casing;

a ground fault circuit interrupter (GFCI) switch mounted within the casing;

an ironing press in electrical communication with the GFCI switch; and a winding spool mounted within the casing, wherein the insulated mat is selectively wound about the winding spool, and wherein the winding spool comprises support rod and a retraction spring extending from the support rod.

16. The ironing assembly of claim 15, further comprising a detection switch in operative communication with the recess to detect the ironing press thereon, wherein the detection switch is disposed in electrical communication with the GFCI switch.

17. The ironing assembly of claim 15, further comprising a power receptacle mounted to the casing.

18. The ironing assembly of claim 17, wherein the GFCI switch is provided within the power receptacle.

19. The ironing assembly of claim 15, wherein the casing comprises a platform defining a recess complementary to the ironing press, and wherein the ironing press is selectively received within the recess.

* * * * *